US007614343B2

(12) United States Patent
Eckert

(10) Patent No.: US 7,614,343 B2
(45) Date of Patent: Nov. 10, 2009

(54) METHODS FOR THE COMPENSATION OF A TRANSVERSE ELONGATION AND/OR LONGITUDINAL ELONGATION OF A PRINTING MATERIAL AND PRINTING PRESS WITH SEVERAL PRINTING COUPLES GENERATING AT LEAST ONE PRINTED IMAGE ON A PRINTING MATERIAL

(75) Inventor: Günther Oskar Eckert, Zellingen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 253 days.

(21) Appl. No.: 10/587,505

(22) PCT Filed: Jan. 21, 2005

(86) PCT No.: PCT/EP2005/050265

§ 371 (c)(1),
(2), (4) Date: Jul. 27, 2006

(87) PCT Pub. No.: WO2005/072967

PCT Pub. Date: Aug. 11, 2005

(65) Prior Publication Data

US 2007/0157831 A1 Jul. 12, 2007

(30) Foreign Application Priority Data

Jan. 28, 2004 (DE) ..... 10 2004 004 264

(51) Int. Cl.
*B41L 3/02* (2006.01)

(52) U.S. Cl. ..... 101/486; 101/217; 101/221; 101/484

(58) Field of Classification Search ..... 101/180, 101/183, 184, 216–221, 248, 484–486
See application file for complete search history.

(56) References Cited

U.S. PATENT DOCUMENTS 4,404,906 A 9/1983 Curran (Continued)

FOREIGN PATENT DOCUMENTS

CH 679 990 A5 5/1992

(Continued)

OTHER PUBLICATIONS

Helmut Teschner, "Offset druck technik," Publication, Technologien und Werkstoffe in der Druckindustrie, Kapitel 10.2, Seiten 10/25 bis 10/82; Kapitel 12; 1989.

(Continued)

*Primary Examiner*—Ren Yan
(74) *Attorney, Agent, or Firm*—Jones, Tullar & Cooper, P.C.

(57) ABSTRACT

At least one of a transverse elongation and a longitudinal elongation of a printing material are compensated for. The printing material passes through serially arranged printing couples in a printing press. A component of the transverse elongation is compensated for after passage of the printing material through a first printing couple and before its entry into a second printing couple. This can be accomplished by the use of a framing controller. Alternatively, this transverse elongation can be compensated for by the displacement of at least one printing form which is situated on a subsequent printing couple. The printing form can be displaced transverse to a production direction of the printing material, relative to a reference mark on the printing material. An elongation of the printing material, which is known at the time of image generation on a printing form of a subsequent printing couple can be compensated for by proper configuration or positioning of the printed image on the printing form.

20 Claims, 4 Drawing Sheets

U.S. PATENT DOCUMENTS

| | | | | |
|---|---|---|---|---|
| 5,056,431 | A | 10/1991 | Sainio | |
| 5,076,163 | A | 12/1991 | Sainio | |
| 5,138,667 | A | 8/1992 | Roch et al. | |
| 5,174,205 | A | 12/1992 | Kline et al. | |
| 5,365,847 | A | 11/1994 | Pers | |
| 5,500,801 | A | 3/1996 | Loffler | |
| 5,553,542 | A | 9/1996 | Jackson et al. | |
| 5,806,430 | A | 9/1998 | Rodi | |
| 5,806,431 | A | 9/1998 | Muth | |
| 5,813,333 | A | 9/1998 | Ohno | |
| 5,816,151 | A * | 10/1998 | Wang et al. | 101/171 |
| 5,913,267 | A | 6/1999 | Britsch | |
| 6,021,713 | A | 2/2000 | Glockner et al. | |
| 6,024,504 | A | 2/2000 | Weichmann et al. | |
| 6,253,678 | B1 | 7/2001 | Wentworth | |
| 6,550,384 | B1 | 4/2003 | Langsch | |
| 6,729,239 | B2 * | 5/2004 | Edamitsu et al. | 101/485 |
| 7,040,233 | B2 | 5/2006 | Seyfried | |
| 2003/0047092 | A1 | 3/2003 | Dufour et al. | |

FOREIGN PATENT DOCUMENTS

| | | | |
|---|---|---|---|
| DE | 69220035 | T2 | 1/1992 |
| DE | 4334712 | A1 | 10/1993 |
| DE | 43 27 646 | A1 | 4/1994 |
| DE | 295 01 373.7 | | 6/1995 |
| DE | 195 26 373 | A1 | 2/1996 |
| DE | 195 16 368 | A1 | 11/1996 |
| DE | 19724066 | A1 | 6/1997 |
| DE | 196 20 997 | A1 | 11/1997 |
| DE | 197 24 066 | | 12/1998 |
| DE | 197 47 728 | A1 | 5/1999 |
| DE | 10066162 | B4 | 4/2000 |
| DE | 101 10 640 | | 10/2001 |
| DE | 42 24 235 | C2 | 12/2001 |
| DE | 101 35 773 | A1 | 2/2003 |
| EP | 1 048 460 | A2 | 11/2000 |
| EP | 0 938 414 | B1 | 2/2002 |
| EP | 1 182 035 | A2 | 2/2002 |
| EP | 1245384 | A2 | 3/2002 |
| EP | 1 048 460 | A3 | 10/2002 |
| EP | 1 245 384 | | 10/2002 |
| EP | 1 182 035 | A3 | 4/2004 |
| JP | 2-81632 | | 3/1990 |
| JP | 11328451 | A | 11/1999 |
| WO | WO 92/12592 | | 7/1992 |
| WO | WO 03/084751 | A1 | 10/2003 |

OTHER PUBLICATIONS

Hans B. Bolza-Schunemann, "6-Platten-breite Zeitungsmaschinen—Geschichte und Tatsachen," pp. 150, 152, 154, 156, 158; Sep. 1991.

"Heidelberg Announces New Triple-Width Newspaper Press", Heidelberger Druckmaschinen AG; Oct. 10, 2000.

Newspapers & Technology, "Triple-width updated: MAN Roland, KBA roll out six-wides"; Jan. 2002.

"KBA baut seine Marktposition im amerikanischen Telefonbuchdruck weiter aus," May 11, 2000.

"Mediaprint in Wien investiert in modernste Zeitungstechnik von Koenig & Bauer," Jun. 27, 2000.

"Auzug aus Homepage von Koenig & Bauer AG: Vorteile 6/2-Konfiguration".

Helmut Kipphan, "Handbuch der Printmedien Technologien und Prouktionsverfahren," Publication, Springer.

Wolfgang Walenski, "Der Rollen Offsetdruck," Textbook, Geschichte Moderne Technik Materialien (Fellbach), (p. 249), (1995).

Helmut Kipphan, "Handbuch der Printmedien," Textbook, Technologien und Produktionsverfahren (Berlin), (p. 161-163, 290 and 307), (2000).

Helmut Kipphan, "Handbook of Print Media," Technologies and Production Methods, Springer (Heidelberg and Germany), (p. 155-158; 278; 279; 294 and 295), (2001).

* cited by examiner

METHODS FOR THE COMPENSATION OF A TRANSVERSE ELONGATION AND/OR LONGITUDINAL ELONGATION OF A PRINTING MATERIAL AND PRINTING PRESS WITH SEVERAL PRINTING COUPLES GENERATING AT LEAST ONE PRINTED IMAGE ON A PRINTING MATERIAL

CROSS-REFERENCE TO RELATED APPLICATIONS

This patent application is the U.S. national phase, under 35 USC 371, of PCT/EP2005/050265, filed Jan. 21, 2005; published as WO 2005/072967 A2 and A3 on Aug. 11, 2005, and claiming priority to DE 10 2004 004 264.0, filed Jan. 28, 2004, the disclosures of which are expressly incorporated herein by reference.

FIELD OF THE INVENTION

The present invention is directed to methods for compensating for a transverse elongation and/or for a longitudinal elongation of a material to be imprinted, and to a printing press with several printing groups which forme at least one print image on a material to be imprinted.

BACKGROUND OF THE INVENTION

A method and a device for use in adapting the position of printing plates to a deformation of a paper web to be imprinted by printing rollers is known from DE 195 16 368 A1. The printing plate, or the holder receiving it in a punching and/or bending machine, is respectively displaced or is offset in the lateral direction, in the circumferential direction and/or in its angular position by those amounts which the printing plate requires on its printing roller because of the deformation of the paper web. This is done in order to provide an imprint which corresponds with a previous printing roller, in the feeding direction of the paper web, in spite of the deformation of the paper web which had taken place in the meantime. Bending and/or punching of the plate or holder is performed on this printing plate displaced from its zero position. A computer-controlled alignment device, in the punching and/or bending machine, is employed for this purpose, after the respective data regarding the paper web, the printing press and the production type have been entered in the computer. In this case, the deformation of the paper web, which is also known by the term "fan out", is caused by moisture, by ink absorption and by mechanical stresses in the course of the passage of the paper web through several pairs of printing rollers which are arranged one after the other.

Image regulation systems for counteracting the "fan out effect" are known from DE 295 01 373 U1, from DE 42 24 235 C2, from DE 43 27 646 A1 and from EP 0 938 414 B2. In these systems the image regulators operate mechanically or pneumatically, for example.

SUMMARY OF THE INVENTION

The object of the present invention is directed to providing methods for compensating for a transverse elongation and/or for a longitudinal elongation of a material to be imprinted and to a printing press with several printing groups which forme at least one print image on a material to be imprinted.

In accordance with the present invention, this object is attained by imprinting a material to be printed, as that material passes through successive printing groups of a printing press, which printing groups are arranged one after another. A portion of a material web transverse elongation is compensated for by an image regulator after the material has passed through one printing group and prior to its entry into the next printing group. This elongation is compensated for by the configuration or the positioning of a print image location on the printing forme of a forme cylinder in the printing group.

The advantages to be attained with the present invention lie, in particular, in that a transverse elongation of the material to be imprinted is, in particular, very extensively compensated for. This occurs, on the one hand, in that an image regulator, which is controlled by a control unit, reduces the material to be imprinted, in its width, in a manner adapted for counteracting the transverse elongation of the material. Preferably, the control unit takes further factors which affect the transverse elongation of the material, into consideration and thus controls the actuation of further installations, in particular in or at the cylinders, for counteracting the results of the "fan-out effect". Moreover, at the time of applying the print image to the printing forme, it is advantageous, in accordance with the present invention, to compensate for a known portion of the transverse elongation and/or for the longitudinal elongation of the material to be imprinted by the at least one printing forme, which is to be arranged on a downstream-located printing group. This can be accomplished by the by the configuration and/or the positioning of a print image location on the printing forme. By this, it is possible to compensate for systematic deviations, and in particular, for deviations between printing groups following each other, to a large extent. The solution of the present invention relieves the operators of the printing press of conducting time-consuming checks of the correct position of the printing forme containing the print image location, and of an alignment of the position of the printing forme on the forme cylinder. This advantage becomes all the greater the more printing formes are involved in the printing process. In a printing press which, for example, employs four printing colors for use in imprinting, such as, for example, a newspaper printing press with, for example, twelve printing formes on each forme cylinder, a considerable advantage results by the controlled matching of the print image locations to the print image. Otherwise, the positions of a total of forty-eight printing formes would have to be checked and aligned for fan-out compensation on the four forme cylinders. In case of a simultaneous recto and verso printing process, twice the number of printing formes, namely ninety-six, have to be aligned with each other in the above-mentioned example, because of which, an outlay of time and personnel, for checking the position of the printing formes, as well as for checking their alignment with each other, is required, which outlay can no longer be efficiently managed.

BRIEF DESCRIPTION OF THE DRAWINGS

Preferred embodiments of the invention are represented in the drawings and will be described in greater detail in what follows.

Shown are in.

DESCRIPTION OF THE PREFERRED EMBODIMENT

Figure 1:
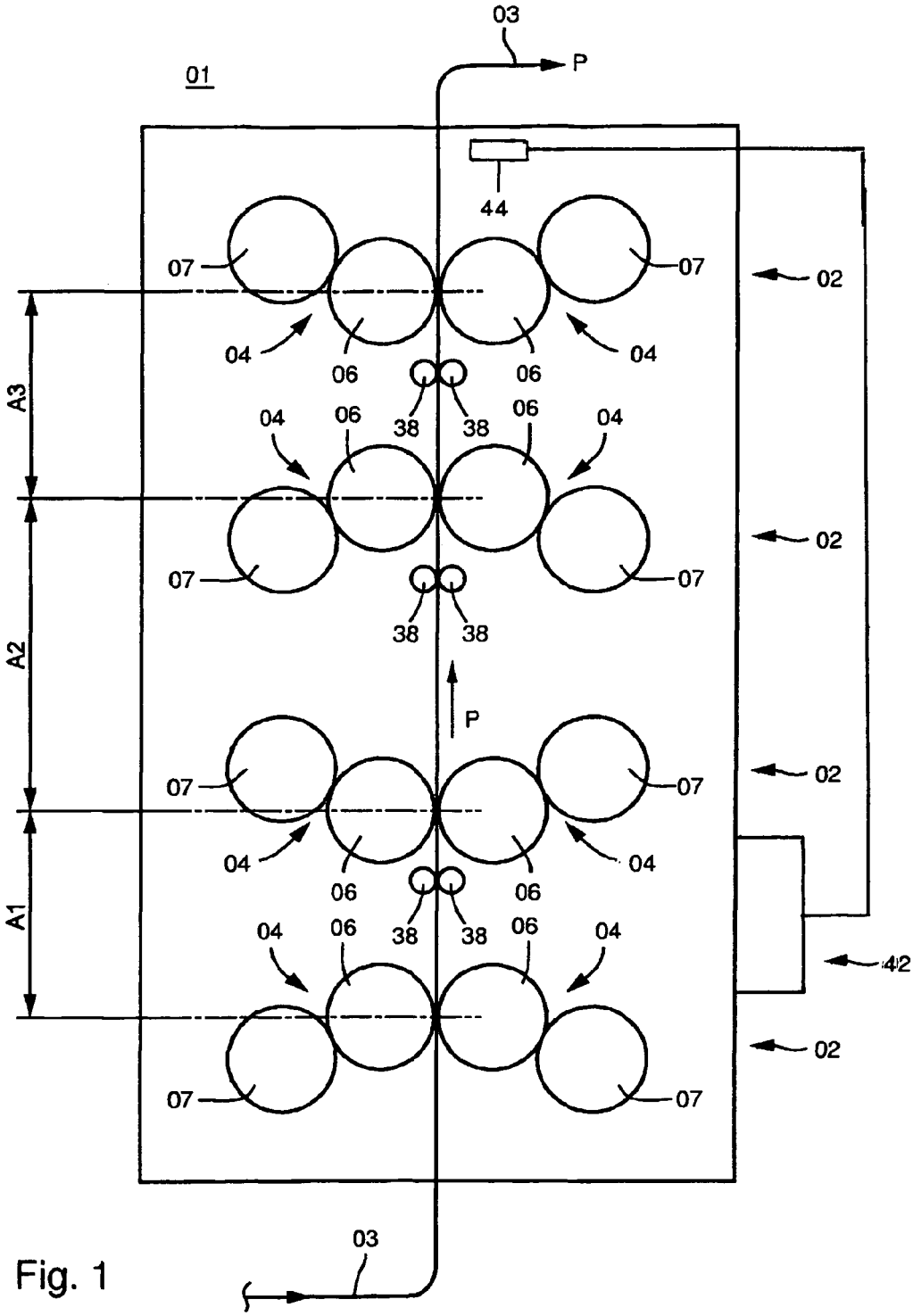
FIG. 1, a schematic side elevation representation of a printing press, suitable for multi-color printing, and having four printing units, each with two printing groups, in FIG. 2, a schematic top plan view representation of four forme cylinders, arranged downstream of each other, and with printing forms with print image locations, in FIG. 3, a perspective view of a printing group with print images formed on a material to be imprinted, and in FIG. 4, a holding device arranged in a channel of a forme cylinder.

In a greatly simplified form, FIG. 1 schematically shows a printing press 01, preferably a printing press 01 which imprints a web 03 in several different colors, such as, for example, a printing press 01 for newspapers, and having four printing units 02 which are arranged vertically on top of each other, for example. A material 03 to be imprinted, such as, for example, a web 03 of material, and in particular a paper web 03, passes vertically through the successive printing units 02. A production flow or direction P of the material 03 to be imprinted passing through the printing press 01 is assumed to substantially move from the bottom to the top, as indicated by the arrow in FIG. 1.

In the configuration represented schematically in FIG. 1, a respective printing group 04, including a cylinder 06 for transferring ink and a forme cylinder 07, which rolls off on the transfer cylinder 06 which is transferring the ink image from the forme cylinder 07, is arranged on each of the two sides of the paper web 03 in each printing unit 02, for accomplishing recto and verso printing. The specific representation of an associated inking system, a dampening system and further components, which are typically part of the printing group 04, for example, has been omitted here, since they are not necessary for an understanding of the invention. The cylinders 06 transferring ink are preferably embodied as transfer cylinders 06 which are operating by the offset printing method. The transfer cylinders 06 preferably each have an elastic surface. That elastic surface is constituted, for example, by at least one printing blanket which is made of an elastomeric material and which is arranged on the shell face of the transfer cylinder 06.

In the preferred embodiment of FIG. 1, the transfer cylinders 06, which are arranged on both sides of the paper web 03 in each printing unit 02, have been placed against each other in a so-called rubber-to-rubber arrangement. The two transfer cylinders 06, which are arranged in the same printing unit 02, alternatingly each function as a counter-pressure cylinder. Alternatively, two adjoining printing units 02 can be combined into a satellite printing unit. The printing groups 04 of these printing units 02 are then arranged around a common counter-pressure cylinder, which is separate from the remaining cylinders 06, 07. The paper web 03 is conducted between the counter-pressure cylinder and at least one transfer cylinder 06 which is placed against the counter-pressure cylinder in such a satellite printing unit.

A further alternative for the configuration of the printing press 01 can be provided if the printing press 01 is to be configured as a job-printing press 01, and preferably as such a printing press 01 with a substantially horizontal guidance of the material 03 to be imprinted. Several successive printing groups 04 are typically provided in the printing press 01 along the production flow or travel direction P of the material 03 to be imprinted, and are preferably located on both sides of the material 03, i.e. both underneath and on top of the material 03 to be imprinted. The transfer cylinders 06 of two printing groups 04, which are arranged in a printing unit 02, are again placed against each other in a rubber-to-rubber arrangement. The material 03 to be imprinted is conducted between the two transfer cylinders 06 which are placed against each other, so that the material 03 to be imprinted passes through the area in which the two transfer cylinders 03 roll off on each other.

Figure 2:
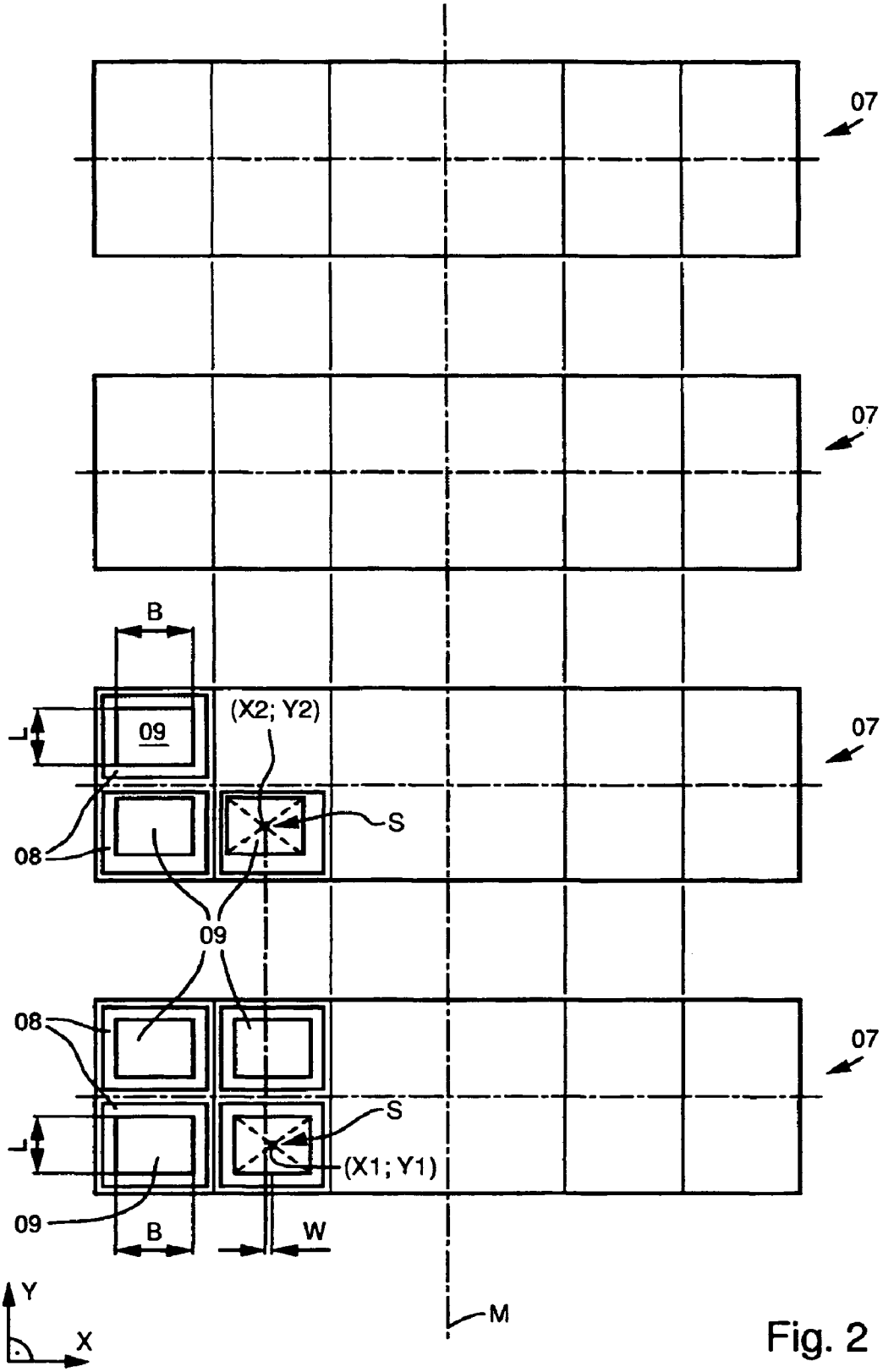

The forme cylinders 07 which are assigned to the transfer cylinders 06 each have at least one printing forme 08, as seen in FIG. 2 on their shell faces. In their axial direction X and/or in their circumferential direction Y, the forme cylinders 07 are each preferably covered by several printing forms 08. For example, in a newspaper printing press 01, the forme cylinders 07 are each covered, in their axial direction X, with six printing forms 08, and are each covered, in their circumferential direction Y, with two printing forms 08. This results in twelve printing forms 08 being arranged on each forme cylinder 07. A developed view of such forme cylinders 07, each with twelve printing forms 08, is represented schematically in FIG. 2. The directional arrows X, Y, which are part of FIG. 2, and which extend at right angles to each other, show the axial direction X of the forme cylinder 07 and the circumferential direction Y of the form cylinder 07.

Figure 3:
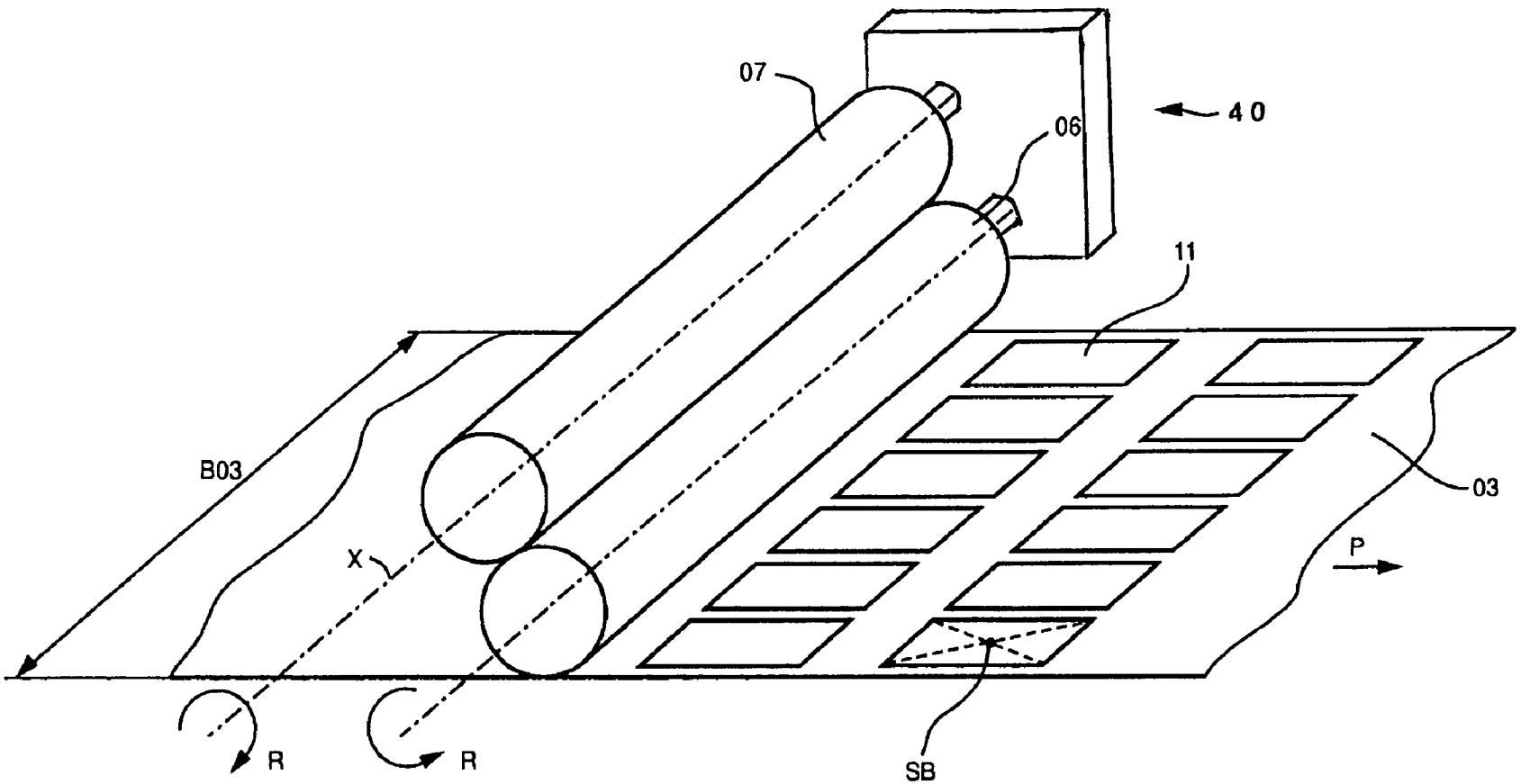

To generate a print image 11, as seen in FIG. 3 on the material 03 to be imprinted, each printing forme 08 has at least one print image location 09, as shown in FIG. 2. It can alternatively be provided that the printing forms 08 have several print image locations 09 in the axial direction X with respect to the forme cylinder 07, and/or in the circumferential direction Y of the forme cylinder 07. By way of example, FIG. 3 shows the generation of six print images 11 on the material 03 to be imprinted in the axial direction X, with respect to the forme cylinder 07. The production flow or direction P of the material 03 to be imprinted, as well as a production direction of rotation R of the forme cylinder 07 and of the transfer cylinder 06 working together with the forme cylinder 07, are indicated. Instead of providing, for example, six printing forms 08 in the axial direction on a forme cylinder 07, and of providing two printing forms 08 in its circumferential direction Y, the forme cylinders 07 can, for example, each be covered by only one printing forme 08, wherein this printing forme 08 has, for example, six print image locations 09 in the axial direction X, with respect to the forme cylinder 07 and/or has, for example, two print image locations 09 in the circumferential direction Y of the forme cylinder 07. Also, every printing forme 07 can have only a single print image location 09.

The printing groups 04, which are arranged one behind, or after, the other, in the production direction P, on the same side of the material 03 to be imprinted, preferably each print inks of colors that are different from each other. For example, ink dots of the colors black, cyan, magenta and yellow, which are the customary colors used in four-color printing, are printed in four successive printing groups 04. Specifically, color dots of one of these colors are printed in each one of these four successive printing groups 04. Print image locations, which correlate with the same resultant print image 11, are located on the forme cylinder 07 of the four successive printing groups 04. Each such print image location constitutes a color separation of the resultant multi-color print image to be created. Each such color separation is assigned to one of the color tones to be printed. A multi-color print image 11 is formed in that several color separations, such as, for example, the four color separations, which correspond to the four respective colors, black, cyan, magenta and yellow, are printed on top of each other onto the material 03 to be imprinted. The color dots of the individual color separations relating to the same resultant print image 11 are arranged either next to each other or on top of each other on the material 03 to be imprinted. The resultant multi-color print image 11 is formed by a color mixture of the color dots resulting from the different color separations.

Each print image location 09 has a width B in the axial direction X with respect to the forme cylinder 07 and a print image location length L in the circumferential direction Y of the forme cylinder 07. Print image locations 09 that each constitute a color separation, for forming a resultant common print image 11, must be printed, or located so that they fit exactly on top of each other, by the utilization of the successive printing groups 04 which are arranged following each other in the production flow or direction P of the material 03 to be imprinted. These print image locations 09 are imprinted on the material 03 by their respective cylinders 06 which transfer the ink from the forme cylinder 07. Adherence to this requirement, which is necessary for a good printing result, is made difficult since the material 03 to be imprinted customarily has a longitudinal elongation along the production flow or direction P, and/or has a transverse elongation crosswise to the production flow or direction P, which elongation occurs on the web's way from one ink-transferring cylinder 06 to a successive ink-transferring cylinder 06, which follows in the production flow or direction P. The longitudinal elongation and/or the transverse elongation of the material 03 to be imprinted results, for example, from the material 03 to be imprinted absorbing moisture that is transported to it by the dampening system of the printing press 01, and/or moisture from the ink, and/or moisture from the air surrounding the material 03 to be imprinted, and/or from a mechanical elongation of the material 03 to be imprinted when that material 03 is passing through several successively arranged printing groups 04. Such a longitudinal elongation and/or a transverse elongation of the material 03 to be imprinted is described by the term "fan out".

If, in connection with a printing press 01, the distances A1, A2, A3, as shown in FIG. 1, between ink-transferring cylinders 06 of successive printing groups 09, which are arranged one behind the other in the production flow or direction P, and a mechanical elongation of the material 03 to be imprinted, and which is possibly occurring between these successive cylinders 06, as well as the moisture-caused elongation of the material 03 to be imprinted, which moisture-caused elongation has been determined, for example, in accordance with DIN 53130, are known, it is possible to determine what changes in the length L and/or in the width B of the print image locations 09, which create a common resultant print image 11 and which print image locations 09 are located in different printing groups 04, are to be expected. Therefore, a defined dimensional change is to be expected for each print image location 09, as a function of its position on the forme cylinder 07 and as a function of the intensity of the several above-mentioned influencing values, in comparison with another print image location 09 which is arranged on another forme cylinder 07 at the same relative position. The dimensional change indicates that the length L of two print image locations 09, following each other in the production flow or direction P of the material 03 to be imprinted, differs by a length factor FL. The width B of two print image locations 09 following each other in the production flow or direction P of the material 03 to be imprinted, on successive forme cylinders 07, differs by a width factor FB. In this case, the factors FL, FB can express a relative dimensional change, such as, for example, in percent, with respect to an original length L or an original width B, or can express an absolute dimensional change, such as, for example, in the form of an amount of change which is based on an original length L or width B.

Each print image location 09 is limited by its length L and width B and defines an area, as seen in FIG. 2, wherein the area of a print image location 09, which is arranged on a forme cylinder 07, is curved or arched. Its curvature is matched to the curvature of the shell face of the forme cylinder 07, in its circumferential direction Y. At the intersection of that area's diagonal lines as represented in dashed lines in FIG. 2, the area of each such print image location 09 has a center point S.

Alternatively to, or in addition to the dimensional change of a print image location 09, a position, X1, Y1, of the center point S of a first print image location 09 can also differ, in comparison with a position, X2, Y2, of a second print image location 09, which is also correlated with the resultant common print image 11, on a subsequent forme cylinder 07 which follows in the production flow P of the material 03 to be imprinted. These print image locations 09 are preferably each arranged on a printing forme 08. The printing formes 08, with the first and second print image locations 09, which differ in the position X1, Y1, X2, Y2 of their center points 5, are arranged in the same respective position on the respective forme cylinders 07. Thus, the printing formes 08, with their respective print image locations 09, remain fixed in place on their respective forme cylinders 07. Only the position X1, Y1, X2, Y2 of at least one of the center points S of two successive print image locations 09, which are following each other in the production flow or direction P of the material 03 to be imprinted, is displaced. Only the positions X1, Y1, X2, Y2 of the center points S of these respective print image locations 09 are changed in relation to each other, by a distance W, as seen in FIG. 2, without changing the position of a printing forme 08 on its respective forme cylinder 07. The distance W is located in the same plane as is the area defined by the length L and the width B of the print image location 09, and can show the displacement of the center point S in this plane in any arbitrary direction, in comparison with the position X1, X2 of the center point S of the related print image location 09.

Since the longitudinal elongation and/or the transverse elongation of the material 03 to be imprinted can have different effects, depending on the position of a printing forme 08 on the forme cylinder 07, the lengths L of two print image locations 09, which are arranged side-by-side on the same forme cylinder 07, in its axial direction X, can differ from each other by a factor FL. The width B of two print image locations 09, which are arranged side-by-side on the same forme cylinder 07 in its axial direction X, can differ from each other by a factor FB. In this case, in a manner that is the same as in the previously described dimensional change, the factor FL, relating to the length L of the print image location 09, is a function of a factor DL of the web longitudinal elongation. The factor FB, relating to the width B of the print image location 09, is a function of a factor DQ of the web transverse elongation. The factor DL of the web longitudinal elongation and the factor DQ of the web transverse elongation take into consideration, for example, the distances A1, A2, A3 between the ink-transferring cylinders 06 of the printing press 01, and which are arranged following each other in the production flow or direction P, as well as the mechanical elongation of the material 03 to be imprinted possibly occurring between these cylinders 06, as well as the moisture-caused elongation of the material 03 to be imprinted. In the course of this consideration, the length L of the print image location 09 is preferably increased by the factor DL of the web longitudinal elongation, and the width B of the print image location 09 is preferably increased by the factor DQ of the web transverse elongation. The factor DL of the web longitudinal elongation and the factor DQ of the web transverse elongation can be changeable. This change can be related to further parameters, and in particular to parameters relating to operating conditions of the printing press 01 and to properties of the material 03 to be imprinted, such as, for example, the production speed of the printing press 01 or the temperature of the air surrounding the material 03 to be imprinted, and, in particular, to the moisture content of this air.

Furthermore, the factor DL of the web or material longitudinal elongation and/or the factor DQ of the web or material transverse elongation can take into consideration that, for example, the transverse elongation, with respect to the print image locations 09 which are "on the outside", with respect to the end of the forme cylinder 07 has a greater effect than a transverse elongation with respect to "inner" print image locations 09, which are arranged close to the center of the forme cylinder 07, provided a center line M, which, for example, halves the cylinder length, serves as a reference, or as a reference marker M for the transverse elongation, as seen in FIG. 2. Also, the factor FL, which differentiates the length L of two print image locations 09 following each other in the production flow or direction P of the material 03 to be imprinted, and/or the factor FB, which differentiates the width B of two print image locations 09 following each other in the production flow or direction P of the material 03 to be imprinted, can depend on the arrangement of that printing group 04 in the production flow or direction P of the material to be imprinted, in which the forme cylinder 07 with the printing forme 08 having the print image location 09 whose length L and/or width B changed by the factor LB, FB is located. This is because there is an effect on the value of the factors FL, FB whether the print image locations 09 of printing groups 04, which directly follow each other, or those of printing groups 04 lying farther apart, are being compared to each other.

In the same way, it can be provided that the position X1, Y1 of the center point S of a first print image location 09 differs, in comparison with the position X2, Y2 of the center point S of another, second print image location 09 that is arranged on the same forme cylinder 07 in the axial direction X of the latter. These print image locations 09 being compared have the same length L and width B. The print image locations 09, which are arranged side-by-side on the same forme cylinder 07, are each arranged on one printing forme 08. The printing forms 08, which are arranged on the same forme cylinder 07 and which have print image locations 09 whose position X1, Y1, X2, Y2 of their center points S differ, have been placed in alignment with each other in the axial direction X of the respective forme cylinder 07. Even in the case of the displacement of the position X1, Y1, X2, Y2 of the center point S of print image locations 09, which are different, but which forme a common print image 11, the distance W of the displacement can be a function of the factor DL of the longitudinal web or material elongation and of the factor DQ of the transverse web or material elongation, regardless of the arrangement of the print image locations 09 on the same, or on forme cylinders 07 which follow each other in sequence in the production flow P.

Figure 4:
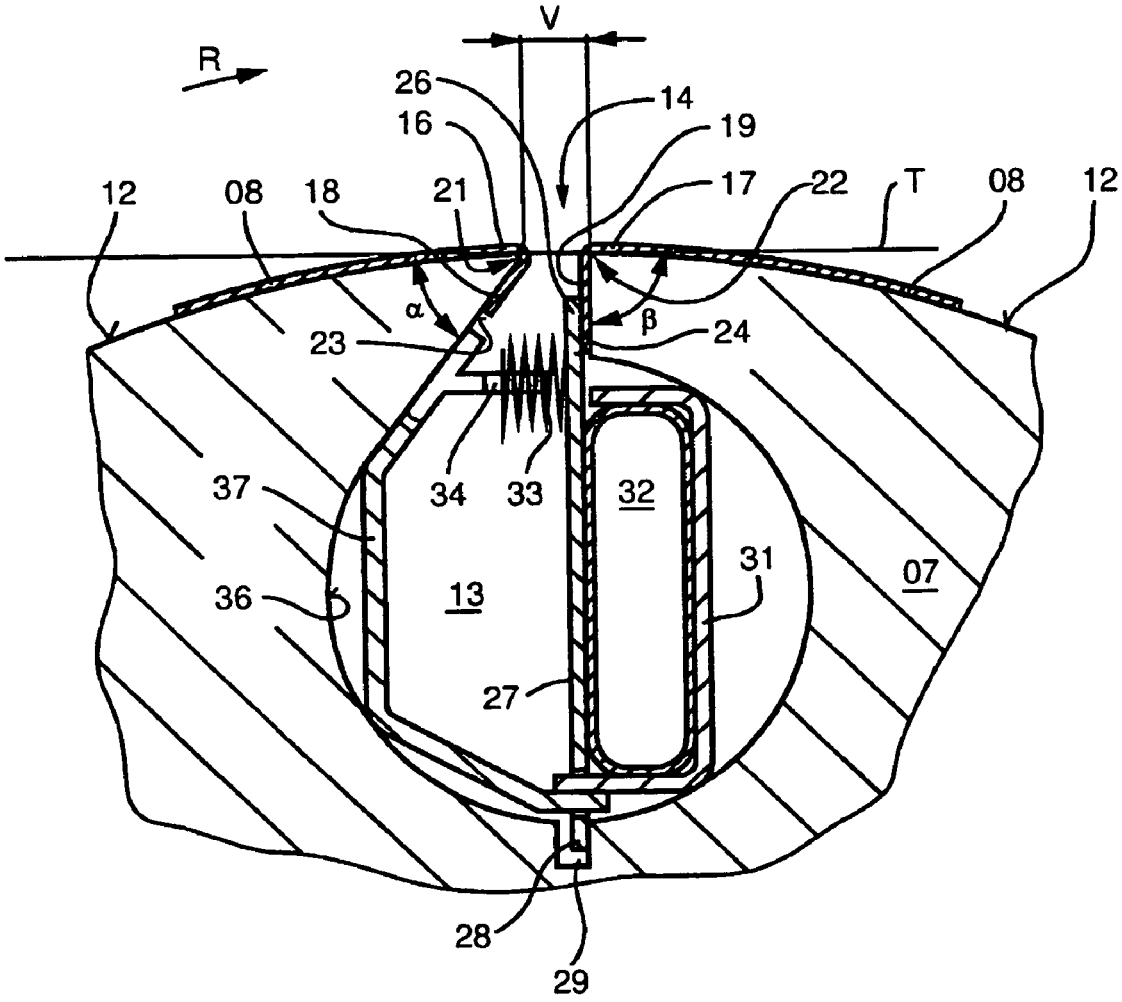

A channel 13, which is extending in the axial direction X underneath the shell face 12 of the forme cylinder 03, and which is provided with a preferably slit-shaped opening 14, for use in holding one or several printing forms 08 on the shell face 12 of a forme cylinder 07 is, for example, provided, as can be seen in FIG. 4. Plate end legs 18, 19, which are beveled or angled off the ends 16, 17 of the printing forme or forms 08, are placed against channel walls 23, 24, which channel walls 23, 24 extend from edges 21, 22 on the shell face 12 of the opening 14 toward the interior of the channel 13. One of the plate ends 16 has been hooked, by means of the plate end leg 18, which leads in the production direction R of the printing forme or forms 08, on the wall 23, which wall 23 extends, in relation to an imaginary tangential line T resting on the opening 14, at a preferably acute opening angle $\alpha$ in respect to the channel 13. The other plate end leg 19 at the end 17 of the printing forme or forms 08 which trails, in the production direction P of the forme cylinder 07, is held by an outer end 26, which is oriented toward the opening 14 by the use of a preferably strip-like holding member 27, against a wall 24 which wall 24, in relation to a tangential line T resting on the opening 14, extends at a preferably approximately right-angled opening angle $\beta$ in respect to the channel 13. An inner end 28 of the holding member 27 that is facing away from the channel opening 14, is pivotably seated, for example in a groove 29, which is situated on, or close to, the bottom of the channel 13. An actuating element 32, such as, for example, a pneumatically actuable actuating element 32, and in particular a hollow body 32 which can be charged with a pressure medium, such as, for example, compressed air, and which is reversibly elastically deformable, and which is preferably a hose 32 is arranged in the channel 13. Hose 32, is, for example, supported on a counter-thrust element 31 which is arranged in the channel 13. If the hose 32 is actuated, it pivots the at least one holding member 27 against the force of at least one spring element 33, that is also preferably arranged in the channel 13. The at least one spring element 33 performs a controlled lift, such as, for example, by the use of a guide element 34 that is assigned to it, which is substantially directed in the circumferential direction Y of the forme cylinder 07. The guide element 34 can be arranged on a support element 37, which itself is supported on an interior, arcuate wall 36 of the channel 13. The opening 14 has a slit width V of preferably less than 5 mm at the shell face 12 of the forme cylinder 07. The slit width V lies between 1 mm and 3 mm in particular. In the embodiment represented in FIG. 4, the holding member 27, the actuating element 32 and the spring element 33 constitute essential elements of a holding device for use in holding one or several printing forms 08 on the shell face 12 of a forme cylinder 07.

It is also possible, for example, to provide at least one register pin, which is not specifically represented in at least one forme cylinder 07. The register pin aligns at least one printing forme 08, arranged on the forme cylinder 07, in an axial direction X, with regard to the forme cylinder 07. The holding device, or the register pin, is configured for working together with at least one printing forme 08 and can be shifted in the channel 13 in the axial direction X of the forme cylinder 07, such as, for example, as a function of the factor DQ of the transverse web elongation, and preferably at a ratio that is proportional to the behavior of the factor DQ of the transverse web elongation. To performe the shifting of the printing forme 08, which shifting is directed particularly in the axial direction X of the forme cylinder 07, preferably at least one controllable actuator, which is not specifically represented, is arranged in the forme cylinder 07, for example in its channel 13. The actuator shifts the holding device or the register pin. The actuator can be configured as a piezo element or as a linear motor, for example. At least one holding device or at least one register pin is preferably assigned to the printing forme 08 on each forme cylinder 07. It is advantageous if each printing forme 08 can be individually shifted in the axial direction X, with respect to the forme cylinder 07.

Alternatively, or in addition to the displacement of one or of several printing forms 08 on a forme cylinder 07, it is possible to provide the entire forme cylinder 07 to be shiftable in its axial direction X, so that all of the printing forms 08 arranged on it are identically shifted. When shifting one or several printing forms 08 on the forme cylinder 07, as well as when axially displacing the entire forme cylinder 07, shifting takes place transversely with respect to the production flow or direction P of the material 03 to be imprinted and relative to the location of the material 03 to be imprinted, i.e. relative to a reference marker M of the material 03 to be imprinted. The reference marker M can be, for example, the center line M of the material 03 to be imprinted, as seen in FIG. 2. However, the reference marker M can also be located at a different spot on the material 03 to be imprinted, such as, for example, at one of its lateral edges. The displacement of the printing forms 08, which is oriented transversely with respect to the production flow P of the material 03 to be imprinted, can also be related to a stationary frame of the printing press 01 instead of to the material 03 to be imprinted.

The forme cylinder 07 and/or the transfer cylinder 06, which transfers ink, of at least one of the two printing groups 04 that are arranged one after or behind the other in the production direction P is preferably driven by a controllable drive mechanism 40 which is represented schematically in FIG. 3 and which may be configured, such as, for example, an electric motor, and in particular a frequency-controlled motor. However, each one of the forme cylinders 07 and/or the ink-transferring cylinders 06 of all printing groups 04, which are arranged one behind the other, may be individually driven. When using controllable drive mechanisms 40 a phase relation, which is assumed with respect to each other of the forme cylinders 07 and/or of the ink-transferring cylinders 06 of at least two printing groups 04, can preferably be controlled as a function of the factor DL of the longitudinal extension. Because of the controllable phase relation of the forme cylinders 07 and/or of the ink-transferring cylinders 06, it is possible, in particular, to affect a circumferential register of the forme cylinders 07.

The actuator, and/or the phase relation of the forme cylinders 07 and/or the phase relation of the ink-transferring cylinders 06, are preferably continuously controllable. The actuator, and/or the phase relation of the forme cylinders 07 and/or of the ink-transferring cylinders 06, are preferably controllable in the running production flow or direction P of the material 03 to be imprinted. In particular, the actuator, and/or the phase relation of the forme cylinders 07 and/or of the ink-transferring cylinders 06, are controllable, such as, for example, from a control console 42, as is depicted schematically in FIG. 1, and that is assigned to the printing press 01 or from another central control unit, i.e. they can be remotely controlled.

It is advantageous to provide a memory unit which is connected with the control unit or control console 42 for at least one of the printing groups 04. The memory unit contains at least one value for the factor FL of the length L of two print image locations 09 which are located behind each other in the production flow or direction P of the material 03 to be imprinted and/or at least one value for the factor FB of the width B of two print image locations 09 which are located behind each other in the production flow or direction P of the material 03 to be imprinted. Alternatively, or additionally, the memory unit can contain at least one value for the factor FL of the length L of two print image locations 09 which are located side-by-side on the same forme cylinder 07 and/or can contain at least one value for the factor FB of the width B of two print image locations 09 which are located side-by-side on the same forme cylinder 07. Furthermore, the memory unit can contain at least one value for the different positions X1, Y1, X2, Y2 of the center point S of two print image locations 09 which are located side-by-side on the same forme cylinder 07.

The control unit can track the center point S of at least one print image location 09, which tracked center point follows a different print image location 09 in the production flow or direction P of the material 03 to be imprinted, with respect to the center point SB of the print image 11 to be imprinted, which center point was displaced during a running printing process, such as, for example, by the longitudinal elongation and/or by the transverse elongation of the material 03 to be imprinted, as seen in FIG. 3. In the process, the control unit controls at least the actuator and/or the phase relation of the forme cylinder 07 and/or of the ink-transferring cylinders 06, preferably as a function of the value for the factor FL and/or the factor FB and/or the positions X1, Y1, X2, Y2 of the center point S which is stored in the memory unit. For example, the center point S of the print image 11 to be imprinted is detected by a detector unit 44, as shown schematically in FIG. 1, and which is connected with the control unit 42 such as, for example, a device which optically detects and digitally evaluates the print image 11, and which may be, for example, a semiconductor camera with a CCD sensor. For example, the control unit 42 can operate devices, which are connected with it, with the result that the center points S of the print image locations 09 which print a common print image 11 are brought into agreement with the center point SB of the common print image 11 to be imprinted.

Methods for compensating for the longitudinal elongation and/or for the transverse elongation, in accordance with the present invention, provide, preferably in advance of a shifting of at least one printing forme 08 on a forme cylinder 07, and wherein that shifting takes place in relation to a reference marker M on the material 03 to be imprinted, that the length L of at least one print image location 09 of a printing form 08, compared with the length L of a print image location 09, which correlates with the same print image 11, of a different printing forme 08 arranged on another forme cylinder 07, is changed by the factor FL. The width B of at least one print image location 09 of a printing forme 08, as compared with the width B of a print image location 09, correlating with the same print image 11 of another printing forme 08 that is arranged on another forme cylinder 07, is changed by the factor FB. Alternatively, or additionally, the position X1, Y1 of a center point S of at least a first print image location 09 of a printing forme 08, compared with the position X2, Y2 of the center point S of a second print image location 09, correlating with the same print image 11, of another printing forme 08, that is arranged on another forme cylinder 07 at the same position of the forme cylinder 07, is changed. In the process, the length L and/or the width B and/or the position X1, Y1, X2, Y2 of the center point S of the print image location 09 is preferably changed by using the factor DL of the longitudinal web elongation and/or the factor DQ of the transverse web elongation. Also, a change of the length L and/or the width B and/or the position X1, Y1, X2, Y2 of the center point S of the print image location 09 is preferably accomplished as a function of the position of the printing forme 08 on the forme cylinder 07, and namely of that forme cylinder 07, on which the printing forme 08, with the changed print image location 09, is arranged.

A value for the factor FL, which changes the length L, is preferably determined as a function of the factor DL of the longitudinal web elongation. A value for the factor FB, which changes the width B, is preferably determined as a function of the factor DQ of the transverse web elongation. The value for the factor FL, which changes the length L, and/or the value for the factor FB, which changes the width B, and/or which changes the coordinates for a new position of the X1, Y1, X2, Y2 of the center point S of the print image location 09 on the printing forme 08 on one of the forme cylinders 07 can also be determined as a function of the print image location 09 of a different printing forme 08, that is arranged in the same position on the forme cylinder 07, on a different forme cylinder 07.

A change of the position L and/or of the width B of a print image location 09, or a change of the position X1, Y1, X2, Y2 of its center point S, for compensating for a portion of the longitudinal elongation and/or of the transverse elongation, which is known at the time the image was applied to the printing forme 08, is preferably performed wherein a printing forme 08, with a print image location 09 which was changed in its above-mentioned parameters, is arranged on a forme cylinder 07 in the same position of a forme cylinder 07 having a printing forme 08 with a print image location 09 which is to be changed. In this way, at least a part of the compensation of the "fan out effect" takes place in connection with the provision of an image on the printing forme 08, i.e. in the course of determining the print image location 09. A print image location 09 which, in comparison with the print image location 09 of another printing forme 08, has already been changed, with respect to its dimensions, and/or with respect to the position X1, Y1, X2, Y2 of its center point S, is arranged at the position on a forme cylinder 07 that is intended for it. In this case, the change is performed to the extent that the change of the dimension and/or of the position X1, Y1, X2, Y2 of its center point S of the print image location 09 is to be expected, such as, for example, as a function of the factor DL of the longitudinal web elongation, and/or the factor DQ of the transverse web elongation of the material web 03 to be imprinted, and/or as a function of the position of the print image location 09 on one of the forme cylinders 07, as well as possibly as a function also of further previously known or determinable parameters. Thus, the change relates to a change of the dimension and/or of the position of the print image location 09 on a printing forme 08, so that systematic deviations, which are to be expected between at least two print image locations 09, are compensated for. Because of this, a change of the position of the printing forme 08 on the forme cylinder 09 is often no longer required, or is only required for fine adjustment or for updating in the course of an ongoing printing process.

To begin with, known or determinable parameters, for taking into consideration the required change of the dimension and/or position of the print image location 09 on a printing forme 08, such as, for example, the factor DL of the longitudinal web elongation, and/or the factor DQ of the transverse web elongation of the material 03 to be imprinted, are supplied to an image application system. That image application system applies the print image location 09, such as, for example, by the use of a laser, to the printing form 08, and is preferably controlled by a computer and on the basis of a digital data set. Therefore, the image application system forms the print image location 09 on a printing forme 08 in accordance with predetermined conditions and, in this way, compensates for the results of the "fan out effect" which are to be expected. In the image application process, the image application system applies the images to the printing forme 08, in particular as a function of the color tone of the cylinder 06 which is transferring the ink, and/or as a function of the arrangement of the printing group 04, with respect to the forme cylinder 07 that is carrying the printing forme 08 in the production flow P of the material 03 to be imprinted, and/or as a function of the position of the printing forme 08 which is arranged on the forme cylinder 07. Thus, in the course of forming a print image location 09, the image application system takes into consideration its position on the forme cylinder 08. This position is customarily determined by an occupation plan that is conceived in a pre-printing stage. Based on the position of the printing forme 08, in accordance with the occupation plan, on one of the forme cylinders 07, the image application system then matches at least some print image locations 09, and preferably matches each print image location 09 in a further printing group 04 that is following a first printing group 04, in its length L, and/or width B, and/or in the position of its center point S, as a function of the above-mentioned influencing values, which were taken into consideration during the formation of the same print image 11. This is done in order to counteract systematic deviations, which are to be expected in the course of the ongoing printing process, and to compensate for these deviations, as much as possible, by a suitable arrangement, or positioning of the print image location 09.

In a further development of the method in accordance with the present invention, a desired value of the factor FL for changing the length L, and/or a desired value of the factor FB for changing the width B, and/or a desired value of the position of the center point S of a print image location 09 of a printing forme 08 to be changed, are continuously determined. Parameters, which are relevant to the above-mentioned changes, are detected and their values are matched, in the course of the ongoing printing process. It is then possible to arrange a printing forme 08, containing the changed print image location 09, on at least one forme cylinder 07, if an actual value of the factor FL for changing the length L, and/or a actual value of the factor FB for changing the width B, and/or an actual value of the position X1, Y1, X2, Y2 of the center point S of the print image location 09 of a printing forme 08 exceeds a permissible deviation from the determined desired values. However, to attain this end, the preparation of a printing forme 08 with a changed print image location 09, and its exchange on the forme cylinder 07 which is involved is required. This can require an interruption of the printing process.

The desired values may be determined for each color tone which is transferred by an ink-transferring cylinder 06. Alternatively, the desired values may be determined for each forme cylinder 07 of the printing groups 04 that are following each other in the production flow or direction P of the material 03 to be imprinted, and/or for each position of a printing forme 08 which is arranged on one of the forme cylinders 07. The determined desired values are preferably stored in a memory and are made available to the image application system as required.

It is furthermore possible, in accordance with the present invention, to counteract at least a part of the transverse elongation of the material 03 to be imprinted by employing an image regulator 38, as depicted schematically in FIG. 1 wherein, prior to its entry into a subsequent or following printing group 04, the material 03 to be imprinted is deformed, preferable in a wave shape, by the image regulator 38 transversely to its production direction R. In this way, the material 03 is reduced, in its width B03, in a manner which counteracts the transverse elongation, as seen in FIG. 3. Preferably, the intensity or the extent of the width reduction takes place at a reverse ratio with respect to the factor DQ of the transverse web elongation, and can preferably also be changed in the course of the ongoing printing process. The deformation of the material 03 to be imprinted can take place, for example, mechanically by the use of rollers which are preferably placed against both sides of the material 03 to be deformed. To prevent the occurrence of negative effects on the quality, these rollers preferably act outside of the print image 11 on the material 03 to be imprinted and are preferably individually rotatorily driven. Another embodiment of the image regulator 38 provides at least one air nozzle that is directed onto the surface of the material 03 to be imprinted. This at least one air nozzle, for example, permits compressed air to flow against the material 03 to be imprinted. In this way the air nozzle deforms the material 03 to be imprinted in a contactless manner. Preferably, several such air nozzles are provided in connection with this pneumatic image regulator 38, which air nozzles are spaced apart from each other. Preferably at least three air nozzles are provided, wherein the air flow of an air nozzle, which is arranged between two other air nozzles is preferably directed counter to the air flow direction of its adjoining air nozzles. The result is that the material 03 to be imprinted, which is charged with the air flow, is deformed in a wave shape. With use of the mechanical, as well as with use of the pneumatic image regulator 38, the deformation of the material 03 to be imprinted can preferably be continuously controlled within defined limits by a control unit which controls the image regulator 38. In particular, this deformation can be controlled remotely from a control console which is part of the printing press 01. The control unit can change the center point SB of the print image 11 by actuating the image regulator 38.

While preferred embodiments of methods for compensation of a transverse elongation and/or a longitudinal elongation of a printing material, and printing press with several printing couples generating at least one printed image on a printing material, in accordance with the present invention, have been set forth fully and completely hereinabove, it will be apparent to one of skill in the art that various changes in, for example, the overall sizes of the various cylinders, the specific web material to be imprinted, and the like could be made without departing from the true spirit and scope of the present invention which is accordingly to be limited only by the appended claims.

What is claimed is:

1. A method for compensating for at least one of a transverse elongation and a longitudinal elongation of a web of material to be printed including:

providing at least first and second printing groups arranged one behind the other in a printing press in a direction of production of a material to be printed;

providing at least a first forme cylinder and at least a first transfer cylinder in said first printing group;

providing at least a second forme cylinder and at least a second transfer cylinder in said second printing group;

providing at least a first printing forme for mounting on said first forme cylinder;

providing at least a second printing forme for mounting on said second forme cylinder;

estimating an amount of at least one of an anticipated transverse elongation and of an anticipated longitudinal elongation which is expected to occur in the material to be printed, during printing of the material by said at least first and second printing groups, and prior to the actual printing of the material by said first and second printing groups;

applying at least one first print image at a selected first print image location on said first printing forme prior to said mounting of said first printing forme on said first forme cylinder;

applying at least one second print image at a selected second print image location on said second printing forme prior to said mounting of said second printing forme on said second forme cylinder;

compensating for said anticipated estimated transverse elongation of the web of material by said applying of said at least one first print image at said first selected print image location on said first printing forme and prior to said mounting of said first printing forme on said first forme cylinder and by said applying of said at least second print image at said second selected print image location on said second printing forme and prior to said mounting of said second printing forme on said second forme cylinder and prior to printing of the web of material;

providing an image regulator in said printing press;

locating said image regulator between, in said direction of production of the web of material, said first and second printing groups;

operating said at least first and second printing groups and printing said at least first and second print images successively on the web of material;

determining an amount of an actual transverse elongation in the web of material occurring as a result of the printing of the web of material in said first printing group;

using said image regulator and deforming said web of material for compensating for said determined actual amount of said transverse elongation occurring in the web of material printed by said first printing group when said actual transverse elongation is greater than said estimated transverse elongation; and providing a controllable printing forme shifting assembly in each of said at lest first and second forme cylinders; and displacing at least one of said at least first printing forme on said first forme cylinder and said at least second printing forme on said second forme cylinder of said second, subsequent printing group using said controllable printing forme shifting assembly and changing said print image location on said at least one of said first and second forme cylinder in response to an additional actual transverse elongation of the material to be printed when said actual transverse elongation is greater than an amount which can be compensated for by using said image regulator, said displacing of said printing forme using said controllable printing forme shifting assembly being accomplished transversely to said direction of production.

2. The method of claim 1 further including deforming said material to be printed in a wave shape using said image regulator.

3. The method of claim 1 further including determining a factor of said transverse elongation as a function of at least one of mechanical elongation and of moisture-related elongation of said material to be printed.

4. The method of claim 3 further wherein said factor of transverse elongation changes.

5. The method of claim 1 further including providing a controllable drive mechanism for at least one of said forme cylinder and transfer cylinder of at least one of said at least first and second printing groups.

6. The method of claim 5 further including determining a factor of said longitudinal elongation of said material to be printed and controlling a phase relation of forme cylinders and transfer cylinders in said at least first and second printing groups as a function of said factor of said longitudinal elongation.

7. The method of claim 6 further including controlling said phase relation continuously.

8. The method of claim 6 further including controlling said phase relation during a printing process in said printing press.

9. The method of claim 6 further including providing a center point on at least one print image location of one of said printing formes and changing a position of said center point using said controllable drive mechanism.

10. The method of claim 9 further including changing said position of said center point during operation of said printing press.

11. The method of claim 9 further including changing said position of said center point using one of a color tone of said ink transfer cylinder, an arrangement of the printing group with said forme cylinder supporting said printing forme in said direction of production, and said position of said printing forme on said forme cylinder.

12. The method of claim 1 further including providing a control console for said printing press and controlling said image regulator using said control console.

13. The method of claim 1 further including providing a detector unit and using said detector unit for detecting at least one center point of a print image being printed from said at least one first print location and said at least one second print location defined by said at least first and second printing formes on said first and second forme cylinders of said first and second printing groups.

14. The method of claim 13 further including using said image regulator for changing said center point.

15. The method of claim 14 further including providing a controllable drive mechanism, using said controllable drive mechanism for driving at least one of said at least first forme cylinder and said at least first transfer cylinder of said at least first printing group and said at least second forme cylinder and said at least second transfer cylinder of said at least second printing group, providing a control unit for said printing press and using said control unit for controlling said controllable drive mechanism for matching said center point of each said print image location of said print image with a center point of a resultant print image.

16. The method of claim 1 further including at least three air nozzles usable to direct air flow transversely to said direction of production on said material to be printed, and using said air nozzles as said image regulator.

17. The method of claim 16 further including directing a middle one of said at least three air nozzles opposite to said first and third of said at least three air nozzles.

18. The method of claim 1 further including an image application system and using said image application system for applying each said a print image to each said printing forme using a digital data set.

19. The method of claim 18 further including providing a distribution plan for creating a print image on each said printing forme, determining a position of said printing forme and using said determined position of said printing forme and applying each said print image using said image application system.

20. The method of claim 1 further including optically detecting and digitally evaluating a print image formed using said at least first and second printing groups.

* * * * *

UNITED STATES PATENT AND TRADEMARK OFFICE

CERTIFICATE OF CORRECTION

PATENT NO. : 7,614,343 B2
APPLICATION NO. : 10/587505
DATED : November 10, 2009
INVENTOR(S) : Eckert It is certified that error appears in the above-identified patent and that said Letters Patent is hereby corrected as shown below:

Column 14, in claim 1, line 18, after "at", change "lest" to -- least --.

Column 16, in claim 18, line 12, before "print", delete "a".

Signed and Sealed this

Twentieth Day of April, 2010

David J. Kappos

David J. Kappos
*Director of the United States Patent and Trademark Office*